US005595446A

United States Patent [19]

Barrus et al.

[11] Patent Number: 5,595,446

[45] Date of Patent: Jan. 21, 1997

[54] PRINTER POWER SUPPLY

[75] Inventors: Gordon Barrus, San Juan Capistrano; Richard E. Schumaker, Orange, both of Calif.

[73] Assignee: Printronix, Inc., Irvine, Calif.

[21] Appl. No.: 321,564

[22] Filed: Oct. 12, 1994

[51] Int. Cl.[6] ..... B41J 29/38; B41J 2/30

[52] U.S. Cl. ..... 400/124.13; 400/54

[58] Field of Search ..... 400/124.03, 124.13, 400/124 TC, 54, 719

[56] References Cited

U.S. PATENT DOCUMENTS

| | | | |
|---|---|---|---|
| 4,540,295 | 9/1985 | Okunishi et al. | 400/124.03 |
| 4,877,344 | 10/1989 | Watahiki et al. | 400/124.03 |

FOREIGN PATENT DOCUMENTS

| | | | |
|---|---|---|---|
| 58-155981 | 9/1983 | Japan | 400/124.03 |
| 59-038070 | 3/1984 | Japan | 400/124.03 |
| 60-172573 | 9/1985 | Japan | 400/124.03 |
| 3-002077 | 1/1991 | Japan | 400/124.03 |
| 6-191118 | 7/1994 | Japan | 400/124.03 |

*Primary Examiner*—David A. Wiecking
*Attorney, Agent, or Firm*—George F. Bethel; Patience K. Bethel

[57] ABSTRACT

A printer is disclosed of the dot matrix type having a series of hammers with pins that print upon an underlying media, and which are released from magnetic retention by reversing the polarity of a permanent magnet and having electromechanical drive circuits and logic circuits. A power supply supplies an output of a voltage level for driving the electromechanical circuits connected to a ribbon drive, platen drive, paper feed, shuttle motor, and fans at a given voltage and the hammers at a different voltage. A thermal sensor is connected to a heat sink of the power supply, and to the printer controller to change the rate of printing when pre-established temperatures are sensed.

6 Claims, 4 Drawing Sheets

12
21
16
26
24
18
19
22
34
28
29
14
10
107

48
50
40
52
24
44
42
3
46
3
54
38

PRINTER POWER SUPPLY

FIELD OF THE INVENTION

The field of this invention is with respect to printers. The invention particularly relates to dot matrix printers which utilize a series of hammers within a hammerbank. The hammers impinge upon a ribbon which is drawn over a piece of paper that is to be printed upon with a platen backing up the paper.

Such printers utilize power supplies which have a particular capacity. These types of power supplies form a portion of this invention.

THE PRIOR ART

The prior art with regard to printers incorporates numerous types of printers. Some of these printers are dot matrix printers. The improvement of this invention over the prior art relates to printers which have a series of hammers that impact a ribbon for printing on a piece of media such as paper.

Such printers are known in the prior art to provide dot matrix printing. In providing dot matrix printing, it is common to have a series of print hammers on a hammerbank that are released in a particular sequence to print upon an underlying piece of paper or other media. The release of the hammers is accomplished through commands that are generated from a host to the controller of the printer. The commands can be formulated into a bit map that emulates the particular format to be printed by the series of hammers of the hammerbank.

Such hammers of the hammerbank in these types of printers are generally retained by a permanent magnet. The permanent magnet is provided with pole pieces that retain the print hammers. The retention of the print hammers is overcome by coils which reverse the magnetic field so as to release the hammers for dot matrix printing action. The hammer releases create the dots incorporated in the dot matrix printing of the invention hereof as known in the prior art.

The coils which are electrically driven for release of the hammers retained by the magnetism draw a significant amount of power.

During the printing process, it is also necessary to provide for motorized movement of the hammerbank on a shuttle basis back and forth across the face of the paper to be printed. Here again, this shuttle motor drive draws a significant amount of power.

In addition to the hammer drive and the shuttle motor drive, a paper feed motor to incrementally move the paper is utilized. The movement of the paper by the motor is a third source of significant power requirement.

In order to draw the print ribbon across the face of the hammerbank against which the hammers can impact, a ribbon motor drive is utilized. This ribbon motor drive can be in the form of one motor drawing the ribbon or winding it around a spool on a spindle while the other spool on a spindle is provided with a second identical motor operating in a drag relationship to provide sufficient drag on the ribbon, which is a fourth power requirement.

As previously stated a platen against which the print hammer impacts are received is utilized. This platen requires opening and closing movements periodically in order to draw the paper or media along at various stages during the operation of moving the paper in an incremental manner, which is a fifth power requirement.

Finally, fans are utilized for such printers in order to provide cooling during the printing process as well as during the standby cycle.

When all of the foregoing power requirements are realized, namely that of the hammerbank drive, shuttle motor, paper feed motor, ribbon motor, platen motor, and fans, it can be seen that during high intensity printing where a high concentration of dots are utilized that significant power can be drawn from the power supply.

In order to provide greater efficiency and higher productivity of such printers, a power supply is provided in conjunction with the printer hereof that is extremely efficient. The power supply functions to accommodate the duty cycle and rate of the printer on an advantageous basis. The prior art did not accommodate such duty cycles, but rather incorporated a power supply that had to meet the worst case condition. The worst case condition of the power supply oftentimes created a situation, where not only did expensive power supplies have to be provided, but also the efficiency of the entire system was not optimized.

The inventors hereof have provided a digital logic output from the power supply that indicates when the power supply is approaching a thermal shutdown. This early warning allows the print load duty cycle or rate to be lessened or backed off. This in turn lowers the entire power requirements and load on the power supply prior to a thermal shutdown.

The signal from the power supply is not sent unless high density printing is being done for a significant period and the ambient temperature is high. In such a case, the power supply triggers a signal which causes the controller of the printer to function on a lower duty cycle, or reduced rate of printing.

The power supply connector to the controller can receive a signal that is low when a high temperature is reached. This in effect causes the software in the controller to begin skipping multiple strokes reducing print rate while maintaining fidelity of output, until the temperature goes sufficiently low as to allow for continued normal duty cycle printing.

The prior art in the past has been such where the system design of printers defined a series of functional blocks including the power supply to assure that they met the duty cycle and system objectives. This caused complexity and increased costs for the design of the power supply.

By way of example, a power supply for a printer could be specified to have a current temperature limit that would assure continued operation under the worst case condition. However, this condition would only be seen a small percentage of the normal operating time. This left the product in the entirety as to both the power supply and the printer at a disadvantageously inefficient level. It also substantially increased costs due to the requirement of designing for the highest operating conditions.

This invention addresses the problem by providing a power supply that monitors its internal operating temperature. The supply sends a digital warning signal to the applicable printer controller when it approaches its maximum desirable operating temperature. Based upon this temperature signal, the system then takes action to reduce the load current on the supply by limiting the tasks of the foregoing power drawing elements of the printer as previously set forth.

Fundamentally, the power supply operates to provide sufficient power over a myriad of printing tasks until excessive density of the print information and printing functions are encountered. At this point, the power supply sends its signal to reduce the print rate until the temperature of the power supply has fallen to a lesser value. This occurs without a total shutdown and interruption in printing. The reduced print rate and lower duty cycle is for a short period of time without affecting the entire printing function.

As a consequence of the foregoing, the power supply monitoring invention hereof for a printer is deemed to be a significant step over the art.

SUMMARY OF THE INVENTION

In summation, this invention comprises a power supply and printer in combination wherein the power supply has a digital output that indicates that the supply is approaching a thermal shutdown thereby allowing the print load to be backed off which lowers the load on the power supply prior to a thermal shutdown.

More particularly, the digital output is generated by a thermal sensing component attached to the heat sinks of the power supply. The signal generated from the thermal sensing component is temperature dependent. Prior to a threshold thermal condition being reached that would shutdown the power supply, a signal is sent in order to cause the controller to diminish the rate of printing. This is provided by a signal that goes low when the high temperature is reached. This signal is conducted to the printer controller which in turn lowers the entire duty cycle of the printer.

The duty cycle is lowered by diminishing the density or rate of printing during a given time. In effect, the load on the power supply being a function of the density of the print information being applied to the media creates the specific load requirements. By lowering the rate of printing, the power requirements are diminished. This reduced printing rate continues until the temperature of the power supply has fallen to a lesser value.

The foregoing happens without a total interruption of the printing as in the prior art. In such prior art printers, either the power supply had to be much larger or a full system shutdown occurred.

When the maximum limits are approached or the predesigned desirable limits which can be 90 or 95 percent of thermal capacity or power supply limitations, the reduced print rate for a shortened period of time goes into effect. This reduced print rate is not detectable by the system operator whereas a full shutdown would require operator intervention.

After the power supply has cooled down, the printing is continued in the normal duty capacity previous to the threshold signal to the controller reducing the rate of printing.

DESCRIPTION OF THE PREFERRED EMBODIMENTS

Figure 1:
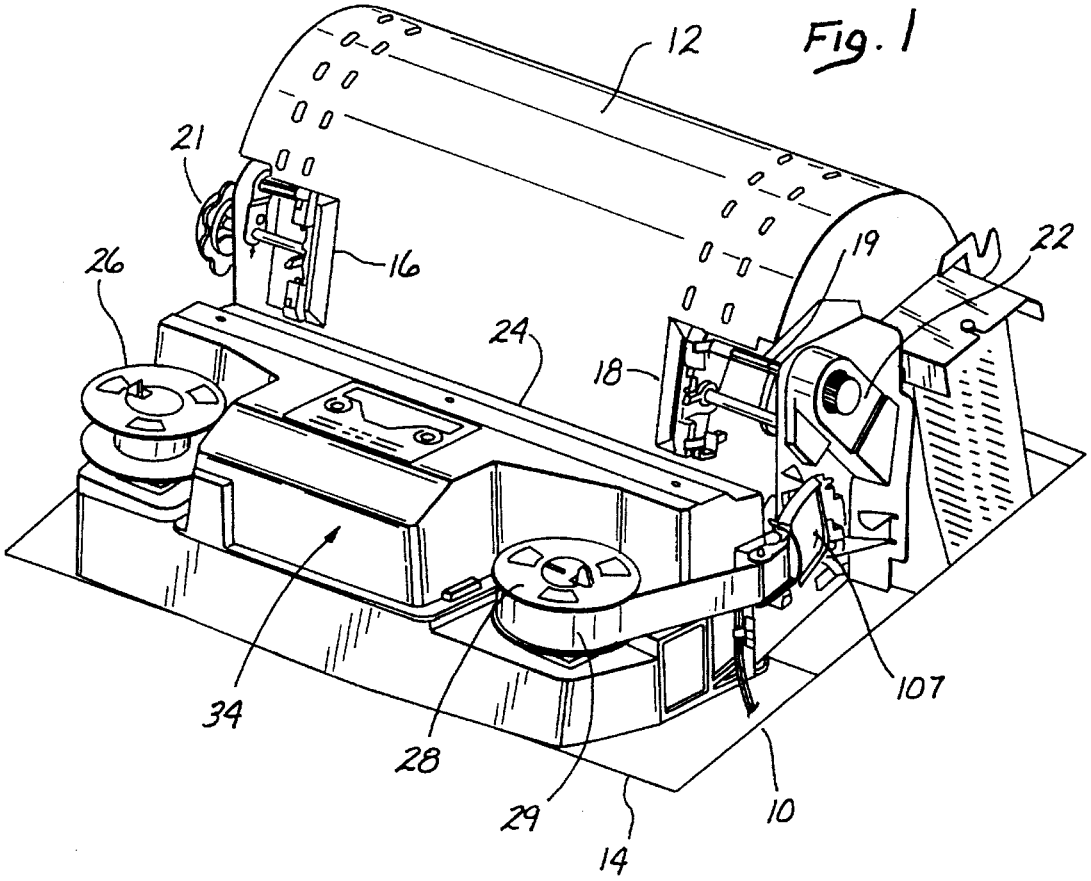
FIG. 1 shows a perspective view of the printer of this invention.

Looking more particularly at FIG. 1 it can be seen that a printer 10 is shown having a cover 12 overlying the top thereof and a base portion 14. The cover 12 and base portion 14 serve to house the printer components of the invention which shall be detailed hereinafter.

The printer has a paper or media feed system including a pair of tractor feeds 16 and 18 on either side that are driven by a paper feed motor that is not seen through a drive linkage 22. The paper drive system includes a splinted shaft 19 connected to the feed motor drive linkage 22. The paper feed system is accommodated so as to move paper over a hammerbank 24 hidden in FIG. 1 having a series of dot matrix hammers having pins to provide the dot matrix printing of this invention. A hand adjustment knob 21 is connected to the tractor 16.

In order to print, a ribbon drive in the form of two (2) spools 26 and 28 are utilized. The spools 26 and 28 are on spindles driven by a ribbon drive motor system. The ribbon drive motor system incorporates two (2) two (2) phased step motors connected to each spindle of spools 26 and 28. The spools 26 and 28 receive a ribbon 29 therearound.

One (1) of the motors is driven by a pulse width modulation (PWM) voltage-mode controller. The other is braked by a PWM voltage-mode controller. When one of the spools is turned by a motor in the winding mode, it is in a driven condition. The other spool which is paying out the ribbon is fundamentally in a drag mode. This operation is incorporated herein by reference as explained and referred to in U.S. patent application Ser. No. 07/807,114 commonly assigned with this invention.

The paper feed system in the form of the tractors 16 and 18 are driven by a two (2) phase stepper motor. This motor is driven by a PWM controller.

A cover 34 shown in FIG. 1 overlays the hammerbank and shuttle mechanism of the invention. This cover 34 generally covers the hammerbank area 24 as detailed in FIG. 3. When the cover is removed, it also exposes the mechanism of FIG. 2.

Figure 2:
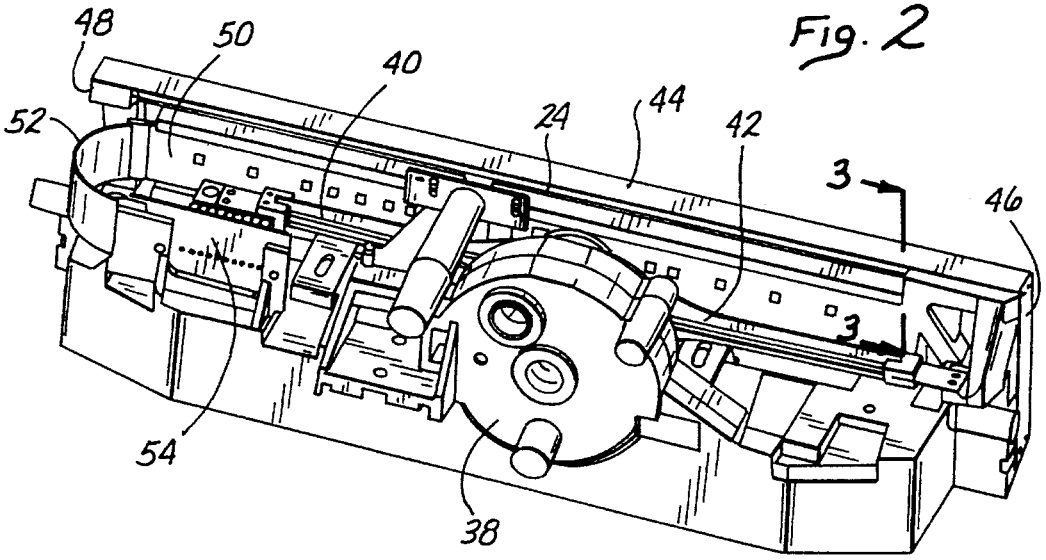
FIG. 2 shows a view of the hammerbank and shuttle drive portions of the printer of this invention underneath a cover of the showing of FIG. 1.

FIG. 2 shows a shuttle motor 38. The shuttle motor 38 is a three (3) phase DC motor driven by a PWM controller. The starting current is limited so that it does not overload the power supply. This is accomplished by rotating a set of eccentrics that drive a pair of shuttle driver arms 40 and 42 in a reciprocating manner. A counterbalance 44 is connected to leaf springs 46 and 48 at either end. The foregoing movement of the hammerbank 24 is known in the prior art in order to allow placement of the respective hammers of the invention to provide printing in a particular location.

Internally of the general structure of the cover 34 and mounted on or under the base 14 are a series of fans which provide cooling. These fans also draw a given amount of current from the power supply.

Looking more specifically at FIG. 2, it can be seen that the hammerbank 24 has a board 50 which is the driver board for driving the hammers in their release mode. This fundamentally is a function of overcoming the magnetism holding each respective hammer until it is ready to be fired.

Connecting the board 50 logically and electrically is a flex connection cable 52. The flex connection cable 52 is connected to a terminator board 54 in order to then be connected to the controller of the printer hereof.

Figure 3:
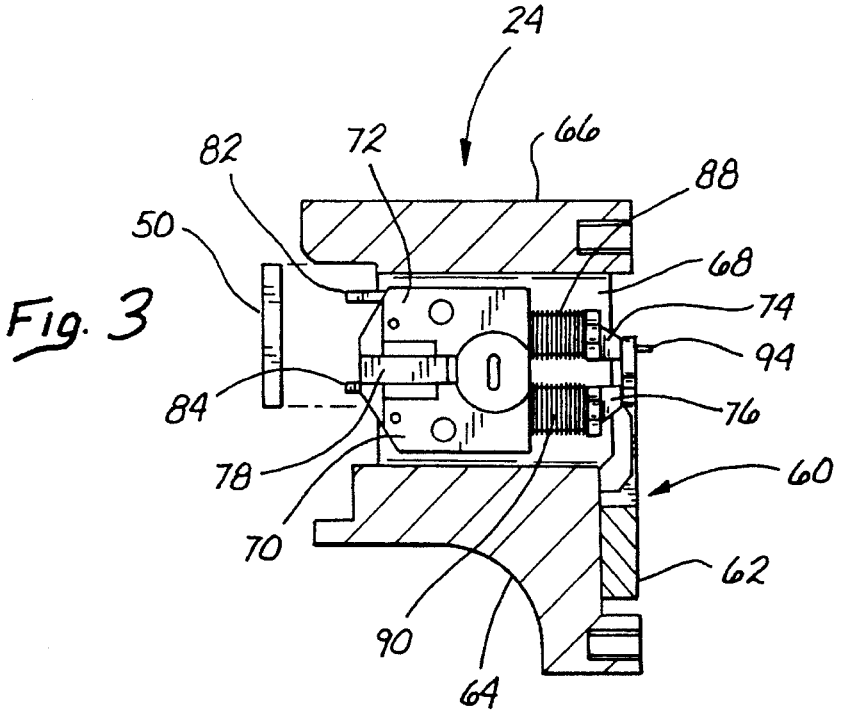
FIG. 3 shows a sectional view of a portion of the hammerbank in the direction of lines 3—3 of FIG. 2.

Looking more particularly at FIG. 3 which is sectioned along lines 3—3 of FIG. 2 it can be seen that a hammer 60 is shown connected at its base 62 to a portion 64 of the hammerbank 24. The hammerbank 24 incorporates an upper and lower portion namely the lower portion 64 and the upper portion 66 both formed from a unitary structure.

Generally, the hammerbank 24 is a solid structure which incorporates a space 68 into which a pair of pole pieces 70 and 72 are placed, terminating in pole piece ends 74 and 76 for magnetic retention of the hammer 60. This retention is maintained by a permanent magnet 78 that can extend along the back of the hammerbank 24.

The driver board 50 is shown overlying two (2) terminals 82 and 84 which are electrically connected for firing the hammers 60 upon command. This is accomplished by the magnetism of the magnet 78 being overcome through coils 88 and 90 that reverse the polarity of the magnet; this causes the hammer 60 of the hammerbank to be released. The release causes a pin 94 of the hammer 60 to move forward and strike the ribbon for purposes of impacting the ribbon against a piece of paperlor other media that is to be printed upon.

The hammer drivers create a load on the power supply. When functioning, it alternately sinks then sources current to the power supply.

Figure 5:
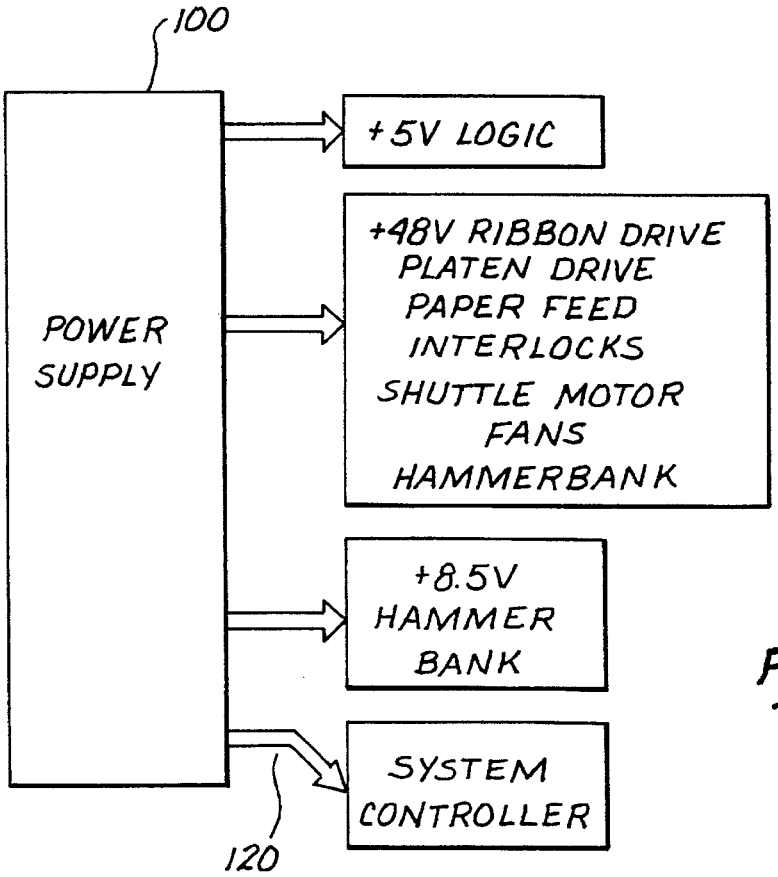
FIG. 5 shows a block diagram of the power supply of this invention and the various outputs thereof in relationship to the controller board.
Figure 4:
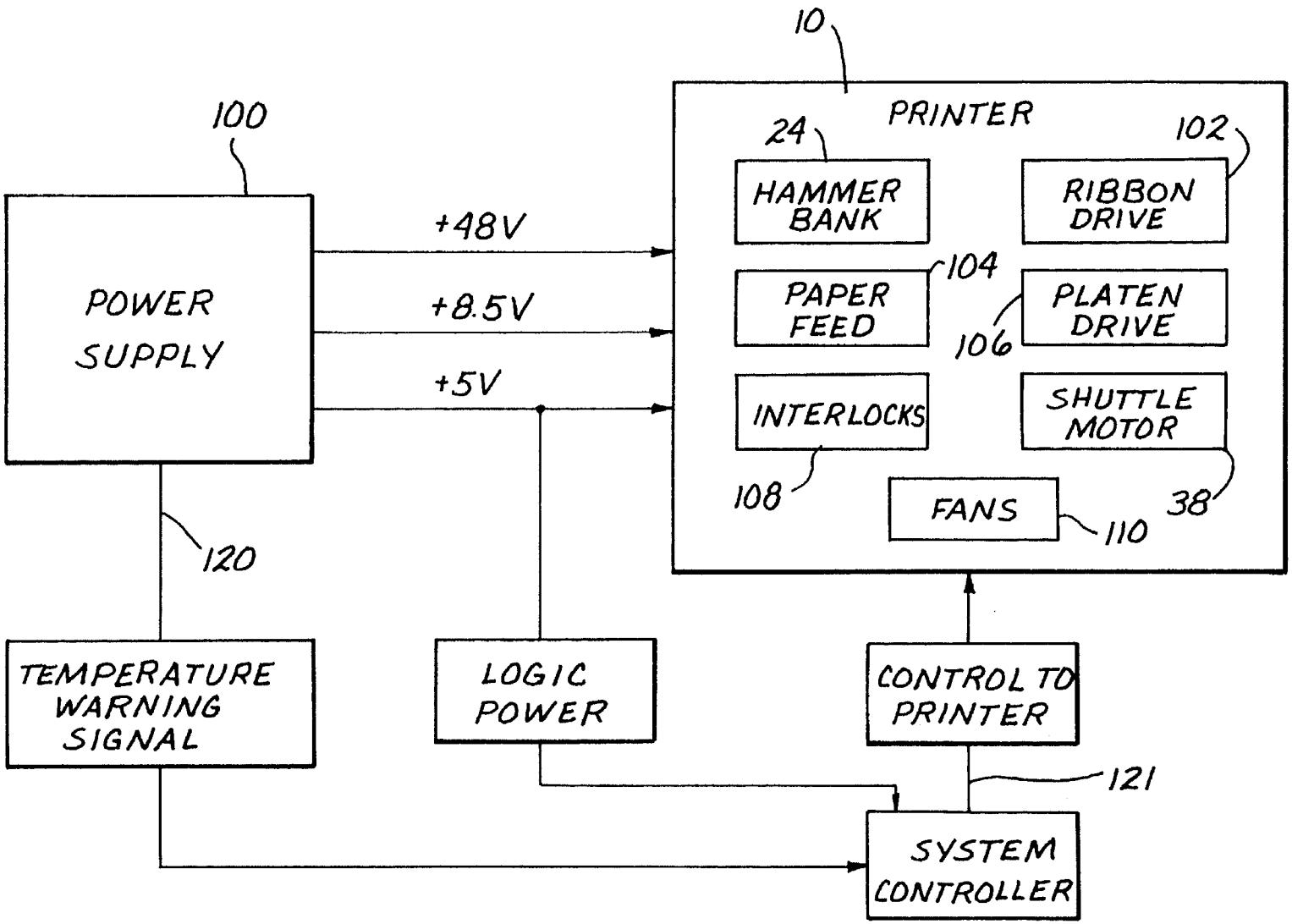
FIG. 4 shows a simplified system block diagram of this invention.
Figure 6:
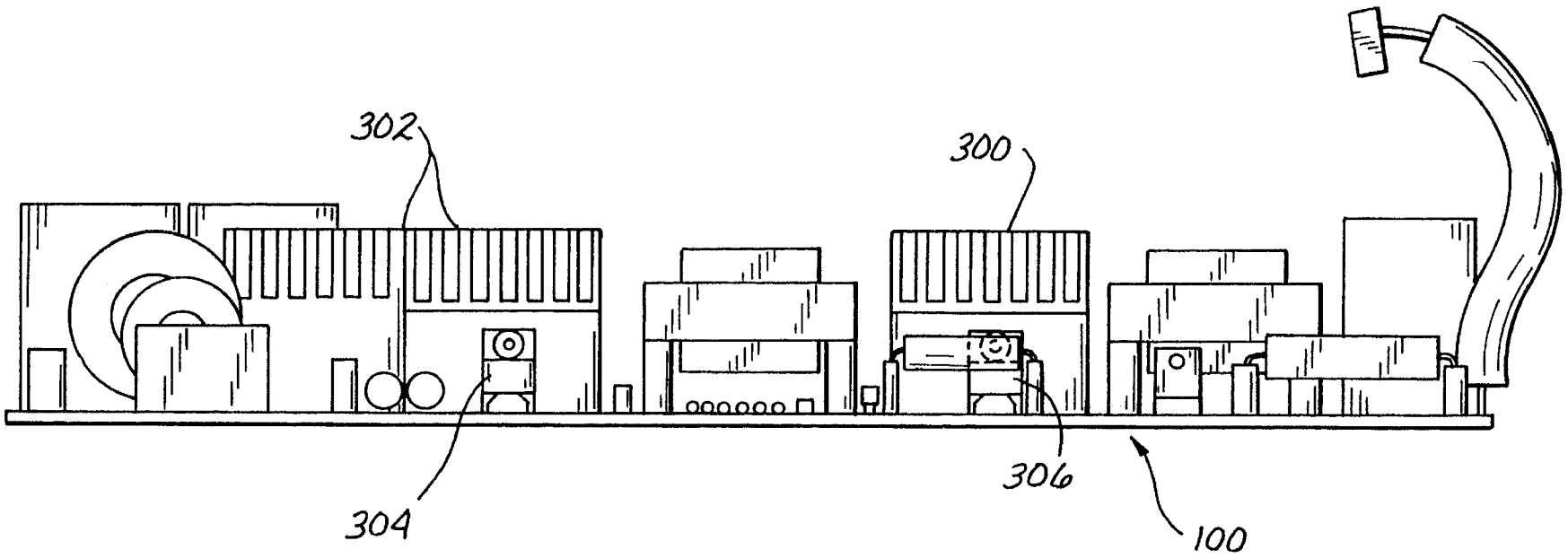
FIG. 6 shows a side elevation view of the power supply with the heat sinks and thermal sensors.

The power supply as seen in FIGS. 4, 5 and 6 is shown as power supply 100. The power supply is connected to the print mechanism of the printer 10 which is generally described hereinbefore in FIG. 1. The printer 10 has a plurality of power requiring elements which are shown as the hammerbank 24 the ribbon drive motors 102 which drive the spools 26 and 28. Also, a paper feed motor and system 104 drive the paper feed 22 which turns the tractors 16 and 18.

A platen drive motor 106 is utilized to move the platen 107 seen in FIG. 1 during the printing operation.

The shuttle motor 38 is shown which also is part of the print mechanism and draws significant power.

Finally, the interlocks 108 also draw power.

In order to maintain the system in a cool relationship, fans 110 are used for the cooling of the entire printer 10.

Looking more particularly at the power supply 100 it must be capable of operating from sufficient mains to provide for a range of conditions. The supply 100 should sense the mains potential and automatically adjust itself for proper operation to provide the power necessary for the operation of the printer 10.

The mains potential should be useable in various conditions with various power sources. This is due to the fact that various cycles such as 50-Hz and 60-Hz systems are encountered throughout the world with various voltages. The mains should thereby be able to tolerate variations in frequency. Any ac input over voltage should be designed into the system to withstand an ac input over voltage of a particular requirement to prevent any degradation of dc output voltage. Inrush currents should be accommodated so that rated inputs for a particular half cycle can be accommodated within normal room temperature conditions.

In order to provide the printer 10 with appropriate power, the power supply 100 has two (2) separate power systems. The first is a +5 volt bus for the logic. The second consists of a +48 volt and +8.5 volt bus for the electro-mechanical portions of the printer 10. The 48 volt portion drives the motors. The 8.5 volt and 48 volt system drives the hammers 60 of the hammerbank 24.

The separate power outputs can be seen in greater detail in FIG. 5 showing the power supply 100 and outputs. The 5 volt logic supply, 48 volts to the motors, hammerbank and the 8.5 volts to the hammerbank are shown and detailed as coming from the power supply.

The power supply 100 incorporates various components as can be seen in the side elevation view that are normally associated with power supplies. The power supply specifically has heat sinks 300 and 302. These heat sinks 300 and 302 are for power regulator transistors. Please keep in mind that the heat sinks for the regulator transistors tend to be one of the warmest portions and require substantial monitoring for temperature.

Attached to the heat sinks 300 and 302 are the thermal sensors 304 and 306. The thermal sensors 304 and 306 can be in the form of bi-metallic switches or other thermal sensors as set forth hereinafter. The outputs therefrom are the ones hereinafter referred to which are on line 120 that go high and that are connected. to the temperature warning signaling system that is connected to the system controller as seen in FIG. 4.

The power supply incorporates an output on line 120 which indicates the high condition. The high temperature condition is by way of a digital output on line 120 that indicates the supply is approaching a thermal shutdown. The signal is sent when high density printing is being done for an extended period of time. This can cause overloading of the equipment of the printer by drawing down significant amounts of power.

The signal is given to a controller board on line 120. The controller board has a pin to receive a signal that goes low when a high temperature is reached. This signal is initially sensed by the two (2) bi-metallic thermal switches, 304 and 306. Each respective thermal switch 304 and 306 is on the heat sinks 300 and 302 of the power supply 100. The bi-metallic thermal switches 304 and 306 have built in hysteresis so as to not send a signal until sufficient sensing time has elapsed. This is usually after the power supply is in a pre-established heated condition in the range of anywhere from 90 to 95 percent of its capacity.

Aside from bi-metallic thermal switches 304 and 306, thermistors connected to a comparitor can also be utilized. Also, there are computer chips known today that monitor exact temperatures, that can send the signal. Any one of the foregoing devices or components can be connected to the heat sinks of the power supply 100 to trigger the signal on line 120.

Looking more particularly at FIG. 4 of the power supply, it can be seen that line 120 providing the temperature warning signal is connected to the system controller. The system controller receives 5 volt power from the power supply to maintain its operational mode on the 5 volt bus.

The output on line 120 goes to the system controller to inhibit the print mechanism of the printer 10. The output on line 20 to the printer 10 indicates an upper thermal limit has been reached.

By way of example, a typical printer power condition is shown in the following example.

EXAMPLE 1

There are two major power conditions for the +48 V and 8.5 V in the printer. One condition is when actual printing is taking place (condition 1). The range of hammer drive current is a product of the print pattern. The second condition is when there is no printing but there is other motor activity (condition 2).

| LOAD | CONDITION 1 (Printing) | CONDITION 2 (Non-Printing) |
|---|---|---|
| 1. Hammer Drive | 0.1–2.3 | 0 |
| 2. Shuttle Motor | 1.63 | 8* |
| 3. Paper Feed Motor | 1.08 (Step) | 1.46 (Slew) |
| 4. Ribbon Motor | 0.97 | 0.97 |
| 5. Fans | 0.6 | 0.6 |
| 6. Platen Motor | 0 | 0.45 |
| Totals | 4.38–6.58 A | 11.48 A** |

*Max Duty Cycle, 1 sec at 8, 2 sec at 1.63, 1 sec at 0.
**Max Duty Cycle, 1 sec at 11.48, 2 sec at 6.58, 1 sec at 3.48

As can be seen, the amperage required for the various loads of the hammer drive, shuttle motor, paper feed motor, ribbon motor, fans, and platen motor vary depending upon the print condition or movement condition. When a significant amount of high density printing is taking place, the foregoing conditions can increase power requirements significantly which causes the temperature warning signal on line 120 to be transmitted to the system controller. This decreases the print duty cycle or rate from the controller on line 121 to the print mechanism of printer 10.

In order to create the standby or shutdown condition as previously described, the printer will not operate unless a logic high signal is provided to the compatible control input on the controller. This is on line 120 which provides the temperature warning signal. This signal is referenced to a 5 volt return.

When the shutdown signal on line 120 is taken to a logic low, the outputs are shutdown and the printer is placed in a standby or shutdown state so that a decreased printing rate can then be undertaken. In order to restore the operation, the system is taken back to a logic high. It should be appreciated that we are talking about a very brief period of shutdown so that the operator will hardly notice the periods of shutdown.

As previously stated and summarized, the power supply 100 provides a compatible output of a logic 1. This signal goes to a logic zero whenever the thermal limit on the heat sinks of the power supply 100 is sensed by the bi-metallic thermal switches. The signal remains low until the power supply 100 temperature has been reduced by at least 5 degrees. Thereafter, the duty cycle resumes, and the controller then continues to provide the outputs necessary to drive the print mechanism of the printer 10 at a normal duty cycle or rate.

From the foregoing, it can be seen that the power supply 100 can be taken to a substantially maximum condition such as 90 to 95 percent capacity until significant temperature is sensed at the bi-metallic thermal switches connected to the heat sinks of the power supply 100. Thereafter, the system controller receiving the signal on line 120 can go into a reduced duty cycle or lower rate of printing until the power supply 100 can cool down and then again supply the normal power necessary for the normal duty cycle.

In effect, the reduced printing rate maintains the power supply consistent and consonant with power requirements at an optimized rate in the printer of this invention and is a significant step over the prior art and should be accorded the claims coverage as hereinafter set forth.

We claim:

1. Amended A printer for dot matrix printing on a media comprising:

a hammerbank having a plurality of hammers which are retained by permanent magnet means;

means for releasing said hammers;

a ribbon drive comprising first and second motors for driving a ribbon by said hammers for imprinting dots on the media by said hammers impinging the ribbon;

means for feeding media over said hammers in said hammerbank;

platen means for supporting said media against which said hammers can impact;

a shuttle supporting said hammerbank for reciprocating shuttle movement across said media;

fans for cooling said printer;

a controller for controlling said printer movement;

a power supply connected to said controller for providing an output o fpower to said printer for driving the ribbon and fans, an for driving the hammers of said hammerback at a different voltage from said ribbon drive and fans, and an output for providing power to the controller of said printer;

thermal sensing means connected to said power supply for sensing its temperature; and, means to signal said controller of a pre-established temperature of said power supply sensed by said thermal sensing means.

2. The printer as claimed in claim 1 wherein:

said thermal sensing means comprises a bi-metallic switch.

3. The printer as claimed in claim 1 wherein:

said thermal sensing means comprises a thermistor connected to a comparitor.

4. The printer as claimed in claim 2 wherein:

said thermal sensing means is connected to a heat sink of said power supply.

5. The printer as claimed in claim 1 wherein said permanent magnet means for retaining said hammers comprise:

at least one pole piece in a magnetic circuit provided by said permanent magnet means;

coil means in association with said pole piece; and, means for electrically actuating said coil means to overcome the magnetism retaining said hammers by said at least one pole piece.

6. The printer as claimed in claim 5 wherein:

said hammers comprise a hammer having a pin at one end thereof which provides the dot of a dot matrix printing by the printer.

* * * * *